US009938030B2

(12) United States Patent
Beniya et al.

(10) Patent No.: US 9,938,030 B2
(45) Date of Patent: Apr. 10, 2018

(54) METHOD OF TRANSPORTING SAPONIFIED ETHYLENE-VINYL ESTER-BASED COPOLYMER PELLETS

(71) Applicant: THE NIPPON SYNTHETIC CHEMICAL INDUSTRY CO., LTD., Osaka (JP)

(72) Inventors: Yasufumi Beniya, Osaka (JP); Shinta Miyazumi, Osaka (JP)

(73) Assignee: THE NIPPON SYNTHETIC CHEMICAL INDUSTRY CO., LTD., Osaka (JP)

( * ) Notice: Subject to any disclaimer, the term of this patent is extended or adjusted under 35 U.S.C. 154(b) by 533 days.

(21) Appl. No.: 14/612,705

(22) Filed: Feb. 3, 2015

(65) Prior Publication Data

US 2016/0176557 A1 Jun. 23, 2016

Related U.S. Application Data

(60) Provisional application No. 62/095,238, filed on Dec. 22, 2014.

(51) Int. Cl.

| | |
|---|---|
| ***B65B 31/00*** | (2006.01) |
| ***B65B 1/04*** | (2006.01) |
| ***B65D 88/74*** | (2006.01) |

(52) U.S. Cl.

CPC ..... *B65B 31/00* (2013.01); *B65B 1/04* (2013.01); *B65D 88/748* (2013.01)

(58) Field of Classification Search

CPC ..... B65B 31/00; B65B 1/04; B65B 31/028; B65B 31/02; B65B 25/067; B65D 88/748

USPC ..... 53/432

See application file for complete search history.

(56) References Cited

U.S. PATENT DOCUMENTS

| | | | | |
|---|---|---|---|---|
| 4,756,447 A * | 7/1988 | Gerhard | B65D 88/744 | 220/565 |
| 5,125,237 A * | 6/1992 | Saia, III | B60H 1/3226 | 62/239 |
| 5,437,837 A * | 8/1995 | Olson | B01D 53/30 | 422/3 |
| 5,718,118 A * | 2/1998 | Eisele | A23B 7/148 | 62/237 |
| 6,256,905 B1 * | 7/2001 | White | A23L 3/34095 | 34/218 |
| 6,615,908 B1 * | 9/2003 | Bosher | A23L 3/3418 | 165/263 |

(Continued)

FOREIGN PATENT DOCUMENTS

JP 2011-006673 A 1/2011

*Primary Examiner* — Sameh Tawfik

(74) *Attorney, Agent, or Firm* — Greenblum & Bernstein, P.L.C.

(57) ABSTRACT

A method of transporting saponified ethylene-vinyl ester-based copolymer pellets by using a hermetic container including a pressurizing means for applying pressure to the interior of the container, and a transport means for transporting the hermetic container. The method comprises the steps of: inserting the saponified ethylene-vinyl ester-based copolymer pellets into the hermetic container to close the hermetic container; and maintaining the interior of the hermetic container in a state of higher pressure than the ambient atmosphere by using the pressurizing means while the hermetic container is transported to a destination by using the transport means.

5 Claims, 1 Drawing Sheet

(56) References Cited

U.S. PATENT DOCUMENTS

| | | | | |
|---|---|---|---|---|
| 7,208,187 | B2 * | 4/2007 | Gabler | A23B 7/152 426/231 |
| 7,228,793 | B2 * | 6/2007 | Ling | A23B 7/148 99/468 |
| 7,347,324 | B2 * | 3/2008 | Nishio | A61J 1/2093 206/213.1 |
| 8,794,259 | B2 * | 8/2014 | Daneshgari | B60K 15/03 137/263 |
| 8,877,271 | B2 * | 11/2014 | Bell | B65D 81/2069 426/107 |
| 9,216,548 | B2 * | 12/2015 | Karbasi | B29B 9/16 |
| 9,291,310 | B2 * | 3/2016 | Nakazono | F17D 1/00 |
| 9,409,770 | B2 * | 8/2016 | Ginzburg | B01D 53/0407 |
| 9,468,220 | B2 * | 10/2016 | Bell | A23B 4/16 |
| 9,497,955 | B1 * | 11/2016 | Rogacki | A01M 13/003 |
| 9,512,002 | B2 * | 12/2016 | Bennington | C01B 3/0084 |
| 2003/0182900 | A1 * | 10/2003 | Bowden | B65B 11/025 53/432 |
| 2004/0112079 | A1 * | 6/2004 | Omuta | A01J 9/04 62/435 |
| 2007/0077480 | A1 * | 4/2007 | Curello | H01M 8/04089 44/457 |
| 2012/0276262 | A1 * | 11/2012 | Schrader | B65D 88/54 426/389 |
| 2014/0124497 | A1 * | 5/2014 | Kooi | B65D 88/744 219/441 |

* cited by examiner

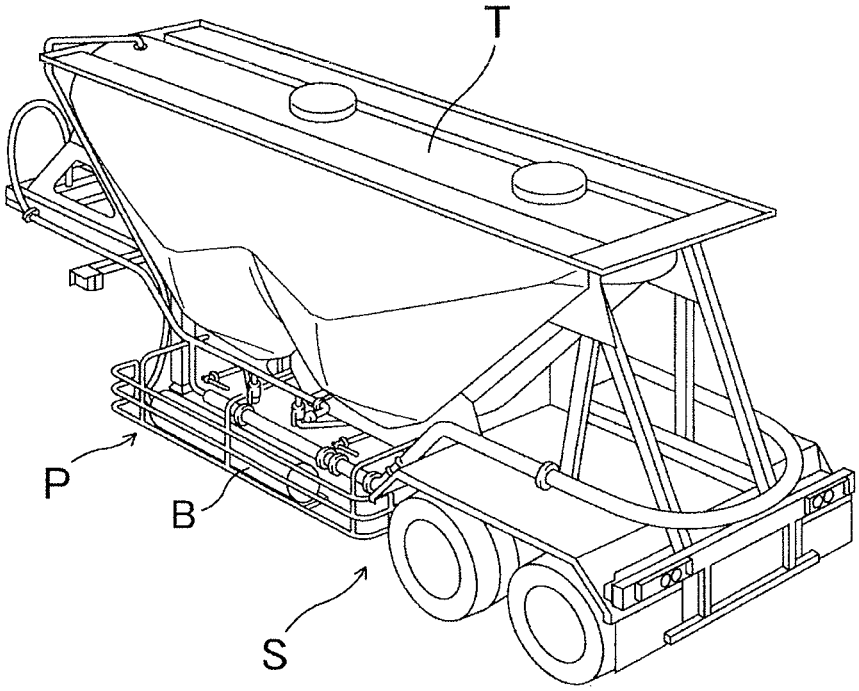
T
P
B
S

METHOD OF TRANSPORTING SAPONIFIED ETHYLENE-VINYL ESTER-BASED COPOLYMER PELLETS

RELATED APPLICATION

This application claims the benefit of U.S. Provisional Application No. 62/095,238, filed on Dec. 22, 2014, which is hereby incorporated by reference.

BACKGROUND OF THE INVENTION

Field of the Invention

The present invention relates to moisture free transport of materials, and particularly polymer materials.

Description of the Related Art

A saponified ethylene-vinyl ester-based copolymer (ethylene-vinyl alcohol-based copolymer resin; which is referred to hereinafter as an "EVOH resin") has a very strong intermolecular force because of the hydrogen bonding of hydroxyl groups present in polymer side chains. Accordingly, films made of the EVOH resin exhibit excellent gas barrier properties. For this reason, the EVOH resin (and "EVOH resin pellets" obtained by pelletizing the EVOH resin) is used for packaging films and packaging container raw materials for water, foods, drinks and the like, and for films and sheets of medical product packaging materials, industrial chemical packaging materials, agricultural chemical packaging materials and the like, or as a molding material for containers such as bottles (as disclosed in Japanese Published Patent Application No. 2011-6673, the disclosure of which is herein incorporated by reference).

In general, the EVOH resin is produced by saponifying an ethylene-vinyl ester-based copolymer in an alcohol solvent in the presence of a catalyst under high-temperature and high-pressure conditions, the ethylene-vinyl ester-based copolymer being obtained by the copolymerization of a fatty acid vinyl ester such as vinyl acetate and ethylene. The EVOH alcohol solution under high-temperature and high-pressure conditions which is obtained in such a saponifying step shall be a water/alcohol mixed solution of EVOH stable at ordinary pressure, and is extruded into a low-temperature coagulating bath having water as a main ingredient so as to be precipitated in the form of strands. The strands are cut, pelletized, and then dried, so that EVOH resin pellets are produced.

The EVOH resin (pellets) has hygroscopic properties. It has been known that, if the EVOH resin (pellets) absorbs moisture to increase the moisture percentage (percentage of moisture content) thereof when in storage, the EVOH resin (pellets) is prone to have a poor appearance resulting from the foaming of moisture and the like during a subsequent molding process of films and the like. To prevent this, the aforementioned EVOH resin, if small in quantity (approximately 25 kg or less), is charged and enclosed in transporting bags having an aluminum layer impervious to moisture when transported in the form of pellets between plants or to a customer or stored therein.

In the case of a large-scale step or plant in which the EVOH resin pellets are used in large quantities in a short time, on the other hand, the use of the transporting bags for small quantities as described above for the transport and storage of the pellets results in the decrease in transporting and operating efficiencies. When the EVOH resin pellets are required in large quantities at one time, it is customary to charge the aforementioned EVOH resin pellets in large-scale closed containers (pellet transport containers) such as large-sized tanks, hoppers and containers, to close the containers, and to transport the containers containing the EVOH resin pellets by using towing vehicles, trains and the like.

For actual transport, storage tank parts of trucks in the form of a trailer (including a large-sized bulk loading vehicle for granules towed by a tractor, such as a semi-trailer and a full trailer) in which a tank for powder and granular materials, a hopper and the like are fixed (normally provided) on a bed (frame), and in the form of a tank truck integrated with a tractor part, and the like are used as large-scale closed containers capable of loading pellets (coarse granules) thereon, as pellet transport containers.

When a large-sized pellet transport container (air closed tank of a trailer for granules, a bulk vehicle and the like) as described above is used to transport EVOH resin pellets, the pellets which remain at a high temperature (hot) after being subjected to hot air drying in the final stage of the manufacturing process thereof are charged into the aforementioned closed tank and transported, with the openings of the tank sealed, for the purpose of avoiding the moisture absorption of the pellets during the transport and storage of the pellets. It has, however, been found that the method of transporting the EVOH resin pellets in the aforementioned manner might cause the aforementioned pellets to absorb moisture during the transport thereof.

As a result of the detailed observation of the state of the pellet transport container being transported, the present inventors have found that, as the temperature of gas within the container which has increased by the charging of the aforementioned hot pellets decreases during the transport of the pellets, a negative pressure resulting from heat shrinkage is developed, so that outside air enters the container. From this fact, it is considered that the moisture absorbed by the aforementioned EVOH resin pellets is brought about by the outside air containing much moisture and coming from the outside of the pellet transport container (closed tank).

There is a danger that such moisture absorption of the EVOH resin pellets during the transport of the EVOH resin pellets causes the occurrence of a large number of failures or poor appearances resulting from the foaming of moisture and the like during the molding process of films and the like. It is therefore desirable to improve the mass transport method of the EVOH resin pellets.

SUMMARY OF THE INVENTION

In view of the foregoing, it is therefore an object of the present invention to provide a method of transporting saponified ethylene-vinyl ester-based copolymer pellets which is capable of transporting dry EVOH resin pellets in large quantities at one time without the moisture absorption of the pellets in the course of the transport of the pellets.

To accomplish the aforementioned object, the present invention includes a method of transporting saponified ethylene-vinyl ester-based copolymer pellets comprising the steps of inserting the saponified ethylene-vinyl ester-based copolymer pellets into a hermetic container to close the hermetic container, the hermetic container including a pressurizing means for applying pressure to the interior of the hermetic container, transporting the hermetic container to a destination by using a transport means for transporting the hermetic container, and maintaining the interior of the hermetic container in a state of higher pressure than the ambient atmosphere by using the pressurizing means for applying pressure to the hermetic container during the transporting step.

The present inventors have diligently made studies to solve the aforementioned problem. As a result, the present inventors have hit upon the idea of always supplying a dry gas with a low moisture percentage into a closed container (pellet transport container) to eliminate the negative pressure developed in the container during the transport of hot EVOH resin pellets being charged into the container. The present inventors have found that the provision of a pressurizing means which always applies pressure to the pellet transport container in the aforementioned pellet transport container completely prevents outside air from flowing into the container during the aforementioned transport. Hence, the present inventors have attained the present invention.

The "dry gas with a low moisture percentage" used for the application of pressure to the pellet transport container according to the present invention is selected based on the rate of occurrence of failures such as moisture foaming and thermal yellowing during a subsequent molding step. A gas with a moisture percentage of not more than 0.8 wt %, particularly an inert gas with a moisture percentage adjusted to not more than 0.8 wt %, is preferably employed. A lower moisture percentage of the gas is more preferably not more than 0.4 wt %, and particularly preferably closer to zero.

The method of transporting saponified ethylene-vinyl ester-based copolymer pellets according to the present invention is capable of transporting the pellets in large quantities at one time without the moisture absorption of the pellets even when transporting resin pellets made of a saponified ethylene-vinyl ester-based copolymer (EVOH) by using a closed type large-sized transport container such as a trailer for granules and a bulk loading vehicle. Thus, the pellet transport method according to the present invention improves the transport efficiency of the pellets while maintaining the quality of the EVOH resin pellets.

The transported EVOH resin pellets do not have a poor appearance and the like resulting from the foaming of moisture during a subsequent molding process of films and the like, so that the yield of the processed products is improved. This improves the quality of the EVOH as the end product and the molded parts produced using the EVOH, and reduces the total costs of the molded parts produced using the EVOH resin pellets in combination with the improvement in the aforementioned pellet transport efficiency (reduction in raw material costs).

BRIEF DESCRIPTION OF THE DRAWINGS

The FIGURE is an external perspective view of a semi-trailer including a tank for powder and granular materials.

DETAILED DESCRIPTION OF THE INVENTION

A preferred embodiment according to the present invention will now be described in detail with reference to the drawing. It should be noted that the present invention is not limited to the preferred embodiment.

A method of transporting saponified ethylene-vinyl ester-based copolymer pellets (EVOH resin pellets) according to the present preferred embodiment is a method which is used for the transport of EVOH resin pellets in large quantities at one time from a manufacturing step (plant) of EVOH resin pellets to user's large-scale manufacturing step or plant in which the EVOH resin pellets are used in large quantities in a short time. The method according to the present preferred embodiment comprises the steps of inserting the EVOH resin pellets into the aforementioned pellet transport container such as a trailer for granules or a bulk loading vehicle which includes a closed type large-sized tank (pellet transport container) and a pressurizing means for applying pressure to the tank and to close the pellet transport container, transporting the hermetic container to a destination by using a transport means, and maintaining the interior of the hermetic container in a state of higher pressure than the ambient atmosphere by using the pressurizing means for applying pressure to the hermetic container during the transporting step.

The aforementioned method of transporting EVOH resin pellets will be described in further detail. Examples of the closed type large-sized tank used herein for the transport of the pellets include storage tank parts of trucks in the form of a trailer S (including a semi-trailer type towed by a tractor, a bulk loading vehicle for granules, and the like) in which a tank T for powder and granular materials is fixed on a bed (frame) as shown in the FIGURE, and in the form of a tank truck integrated with a tractor part.

These closed type large-sized tanks T are configured to be capable of loading (what is called, "loading in bulk") and discharging relatively large granules such as pellets by air transport (pneumatic transportation). The closed type large-sized tank T used in the present preferred embodiment includes sealing (hermetic) means such as block valves mounted to a pellet insertion port and a discharge port. In general, the large-sized tank T used for the transport of pellets as described above is made of stainless steel in consideration of friction with the pellets and the like, and a body of the tank T, except openings such as the aforementioned pellet insertion port, is hermetically sealed. The volume of the aforementioned closed type large-sized tank T generally used is in the range of 30 to 60 $m^3$, and the volume of the aforementioned closed type large-sized tank T preferably used as in this example is on the order of 40 to 50 $m^3$.

Examples of the pressurizing means P for applying pressure to the tank T include a mechanism which includes a cylinder B or a gas generator that fills a gas (dry gas) having a moisture percentage of not more than 0.8 wt % as a supply source and which always supplies the dry gas at a predetermined pressure at a substantially constant flow rate through a pressure regulating valve (regulator) and the like to the tank T. Specific examples of the dry gas supplied to the tank T include: dry air dehumidified to a moisture percentage of not more than 0.8 wt %; preferably inert gases such as nitrogen, argon and helium having a moisture percentage adjusted to not more than 0.8 wt %; and particularly preferably nitrogen gas from the viewpoint of cost and handleability.

The pressure applied to the tank T by using the pressurizing means P is adjusted so that the interior of the aforementioned closed type large-sized tank (pellet transport container) is maintained in a state of higher pressure than the ambient atmosphere, and specifically so that the internal pressure of the pellet transport container is generally more than 1 atm and not more than 1.68 atm (approximately 101.3 to 170.2 kPa), preferably in the range of 1.34 to 1.68 atm (approximately 135.8 to 170.2 kPa), and more preferably in the range of 1.54 to 1.68 atm (approximately 156.0 to 170.2 kPa).

Next, the EVOH resin pellets (saponified ethylene-vinyl ester-based copolymer pellets) used in the aforementioned transport method will be described.

EVOH Resin

The EVOH resin according to the present preferred embodiment is a water-insoluble resin, and is a known resin obtained by saponifying a polymer of ethylene and a vinyl ester-based monomer. The ethylene content of the EVOH resin is generally 20 to 60 mol %, preferably 21 to 55 mol %, particularly preferably 25 to 50 mol %, and more preferably 29 to 48 mol %. When the ethylene content is too low, the resultant molded products, especially stretched films, tend to degrade in gas barrier properties and in external appearance at high humidities. On the other hand, when the ethylene content is too high, the stretched films tend to degrade in gas barrier properties. Such an ethylene content may be measured, for example, pursuant to ISO 14663.

The saponification degree of a vinyl ester component in the EVOH resin is generally not less than 90 mol %, preferably, 93 to 99.99 mol %, and particularly preferably 98 to 99.99 mol %. When the saponification degree is too low, the stretched films tend to degrade in gas barrier properties and in humidity resistance and the like, which is not preferable. The saponification degree of such a vinyl ester component may be measured, for example, pursuant to JIS (Japanese Industrial Standard) K6726 (in a solution such that the EVOH resin is uniformly dissolved in a water/methanol solvent).

The melt flow rate (MFR) of the EVOH resin (210° C., a load of 2,160 g) is generally 1 to 100 g/10 min, preferably 2 to 50 g/10 min, and particularly preferably 3 to 30 g/10 min. When the MFR is too high, the molded products tend to degrade in mechanical strength. When the MFR is too low, extrudability during molding tends to degrade.

The EVOH resin used in the present invention may further include a structural unit derived from comonomers to be described below. Examples of the comonomers include: α-olefins such as propylene, isobutene, α-octene, α-dodecene and α-octadecene; hydroxy group containing α-olefins such as 3-butene-1-ol, 4-penten-1-ol and 3-butene-1,2-diol, and esterified compounds thereof; hydroxy group containing α-olefin derivatives such as acylated compounds; unsaturated carboxylic acids, and their salts, partial alkyl esters, complete alkyl esters, nitriles, amides and anhydrides; unsaturated sulfonic acids and their salts; vinylsilane compounds, vinyl chlorides; and styrenes.

Further, EVOH-based resins which are "post-modified", e.g. urethanated, acetalized, cyanoethylated and oxyalkylenated, may be used.

Of the aforementioned modified products, an EVOH resin such that a primary hydroxyl group is introduced into a side chain by copolymerization is preferable because it is good in post-formability in a stretching process, vacuum forming, pressure forming and the like. In particular, an EVOH resin having a 1,2-diol structure in a side chain is preferable.

The EVOH resin obtained by the aforementioned method may be used as it is. Unless the effects of the present invention are impaired, the obtained EVOH resin may contain compounding agents which are in general compounded into EVOH resins. Examples of the compounding agents include thermal stabilizers, antioxidants, antistatic agents, coloring agents, ultraviolet absorbers, lubricants, plasticizers, light stabilizers, surface-active agents, antimicrobial agents, drying agents, anti-blocking agents, flame retardants, cross-linkers, curing agents, foaming agents, crystal nucleating agents, anti-fogging agents, biodegradation additives, silane coupling agents, and oxygen absorbents.

Additives may be added as the aforementioned thermal stabilizers to the EVOH resin for the purpose of improving various physical properties such as thermal stability during melt molding. Examples of the additives as the thermal stabilizers include: organic acids such as acetic acid, propionic acid, butyric acid, lauryl acid, stearic acid, oleic acid and behenic acid, and their salts such as alkali metal salts (sodium, potassium and the like), alkaline earth metal salts (calcium, magnesium and the like) and zinc salts; and inorganic acids such as sulfuric acid, sulfur dioxide, carbonic acid, phosphoric acid and boric acid, and their salts such as alkali metal salts (sodium, potassium and the like), alkaline earth metal salts (calcium, magnesium and the like) and zinc salts. Of these, it is in particular preferable to add acetic acid, boron compounds including boric acid and its salts, acetates and phosphates.

When acetic acid is added, the amount of acetic acid is generally 0.001 to 1 part by weight, preferably 0.005 to 0.2 part by weight, and particularly preferably 0.010 to 0.1 part by weight to 100 parts by weight of the EVOH resin. When the amount of added acetic acid is too small, the effect of containing the acetic acid tends not to be sufficiently obtained. On the other hand, when the amount of added acetic acid is too large, it tends to be difficult to obtain uniform films.

When a boron compound is added, the amount of boron compound is generally 0.001 to 1 part by weight, preferably 0.002 to 0.2 part by weight, and particularly preferably 0.005 to 0.1 part by weight in boron equivalent (analyzed by ICP spectrometry after ashing) to 100 parts by weight of the EVOH resin. When the amount of added boron compound is too small, there are cases in which the effect of containing the boron compound cannot sufficiently be obtained. On the other hand, when the amount of added boron compound is too large, it tends to be difficult to obtain uniform films.

The amount of acetate or phosphate (including hydrogen phosphate) is generally 0.0005 to 0.1 part by weight, preferably 0.001 to 0.05 part by weight, and particularly preferably 0.002 to 0.03 part by weight in metal equivalent (analyzed by ICP (Inductively coupled plasma) spectrometry after ashing) to 100 parts by weight of the EVOH resin. When the amount of added acetate or phosphate is too small, there are cases in which the effect of containing the acetate or phosphate (including hydrogen phosphate) cannot sufficiently be obtained. On the other hand, when the amount of added acetate or phosphate is too large, it tends to be difficult to obtain uniform films. When two or more types of salts are added to the EVOH resin, it is preferable that the total amount of the two or more types of salts is within the aforementioned range of amounts.

The method of adding acetic acid, a boron compound, acetate and phosphate to the EVOH resin is not particularly limited. Examples of the method include: (i) bringing a porous precipitate of EVOH resin with a percentage of moisture content of 20 to 80 wt % into contact with a water solution of an additive to cause the aforementioned porous EVOH resin to contain the additive, and thereafter drying the porous EVOH resin containing the additive; (ii) causing a homogeneous solution (water/alcohol solution and the like) of EVOH resin to contain an additive, thereafter extruding the resultant solution in the form of strands into a congealed liquid, cutting the obtained strands into pellets, and finally performing a drying process on the pellets; (iii) mixing the EVOH resin and an additive together, and melting and kneading the mixture by using an extrusion machine and the like; and (iv) neutralizing alkali (sodium hydroxide, potassium hydroxide and the like) used in the saponifying step with organic acids such as acetic acid during the production of the EVOH resin, and adjusting the amounts of remaining organic acids such as acetic acid and by-produced salts by a water rinse process. To conspicuously obtaining the effects of the present invention, the methods (i) and (ii) which are excellent in dispersibility of the additive are preferable. To cause the EVOH resin to contain organic acids and their salts, the method (iv) is preferable.

Method of Producing EVOH Resin Pellets

The EVOH resin pellets according to the present invention are produced by pelletizing the EVOH resin obtained by saponifying a copolymer of ethylene and a vinyl ester-based monomer.

Typically, vinyl acetate is used as an example of the vinyl ester-based monomer because it is good in availability on the market and in impurity processing efficiency during the production thereof. Other examples of the vinyl ester-based monomer include: aliphatic vinyl esters such as vinyl formate, vinyl propionate, vinyl valerate, vinyl butyrate, vinyl isobutyrate, vinyl pivalate, vinyl caprate, vinyl laurate, vinyl stearate and vinyl versatate; and aromatic vinyl esters such as vinyl benzoate. Such an aliphatic vinyl ester generally has 3 to 20 carbon atoms, preferably 4 to 10 carbon atoms, and particularly preferably 4 to 7 carbon atoms. These are generally used alone, but may be used in combination, as necessary.

Normal ethylene pressure polymerization may be performed as a method of introducing ethylene into the copolymer of ethylene and the vinyl ester-based monomer. The amount of ethylene to be introduced may be controlled by the pressure of ethylene, and is generally selected from the range of 2.5 to 8.0 MPa although it depends on an intended ethylene content.

Examples of the solvent used for the copolymerization generally include: lower alcohols such as methanol, ethanol, propanol and butanol; and ketones such as acetone and methyl ethyl ketone. Industrially, methanol is preferably used. The amount of usage of the solvent may be selected as appropriate in accordance with the degree of polymerization of an intended copolymer in consideration of the chain transfer constant of the solvent. For example, when the solvent is methanol, S/M (solvent/monomer) is selected from the range of 0.01 to 10 (weight ratio), and preferably from the range of 0.05 to 7 (weight ratio).

A polymerization catalyst is used for copolymerization. Examples of the polymerization catalyst include: known radical polymerization catalysts such as azobisisobutyronitrile, acetyl peroxide, benzoyl peroxide and lauryl peroxide; and low-temperature active radical polymerization catalysts including peroxyesters such as t-butyl peroxy neo-decanoate, t-butyl peroxy pivalate, α,α'-bis(neodecanoyl peroxy) diisopropyl benzen, cumyl peroxy neo-decanoate, 1,1,3,3,-tetramethyl butyl peroxy neodecanoate, 1-cyclohexyl-1-methylethyl peroxy neodecanoate, t-hexyl peroxy neodecanoate and t-hexyl peroxypivalate, peroxydicarbonates such as di-n-propyl peroxydicarbonate, di-iso-propyl peroxydicarbonate, di-sec-butyl peroxydicarbonate, bis(4-t-butylcyclohexyl) peroxydicarbonate, di-2-ethoxyethyl peroxydicarbonate, di(2-ethylhexyl) peroxydicarbonate, dimethoxybutyl peroxydicarbonate and di(3-methyl-3-methoxybutylperoxy) dicarbonate, and diacyl peroxides such as 3,3,5-trimethylhexanoyl peroxide, diisobutyryl peroxide and lauroyl peroxide. The amount of usage of the polymerization catalyst may be arbitrarily selected in accordance with a polymerization rate although it depends on the type of catalyst. For example, when azobisisobutyronitrile or acetyl peroxide is used, the amount of usage of the polymerization catalyst is preferably 0.001 to 0.2 part, and particularly preferably 0.005 to 0.1 part per 100 parts of vinyl ester-based monomer.

According to the present invention, it is preferable that hydroxylactone-based compounds or hydroxycarboxylic acids coexist with the aforementioned catalyst because they provide good color tones (closer to colorless) of the resultant resin composition. The hydroxylactone-based compounds are not particularly limited if they are compounds having a lactone ring and a hydroxyl group in molecules. Examples of such hydroxylactone-based compounds include L-ascorbic acid, erythorbic acid and glucono delta lactone. Preferably, L-ascorbic acid and erythorbic acid are used. Examples of the hydroxycarboxylic acids include glycolic acid, lactic acid, glyceric acid, malic acid, tartaric acid, citric acid and salicylic acid. Preferably, citric acid is used.

In either batchwise or continuous scheme, the amount of usage of such a hydroxylactone-based compound or hydroxycarboxylic acid is preferably 0.0001 to 0.1 part by weight, more preferably 0.0005 to 0.05 part by weight, and particularly preferably 0.001 to 0.03 part by weight per 100 parts by weight of vinyl ester-based monomer. When the amount of usage is too small, there are cases in which the effect of coexistence cannot sufficiently be obtained. On the other hand, when the amount of usage is too large, the result is the impairment of the polymerization of the vinyl ester-based monomer, which in turn is not preferable. The introduction of such a compound into a polymerization system is not particularly limited. Generally, such a compound is introduced into a polymerization reaction system after being diluted with solvents such as lower aliphatic alcohols (methanol, ethanol, propanol, tert-butanol and the like), aliphatic esters (methyl acetate, ethyl acetate and the like) including vinyl ester-based monomers, and water, or their mixed solvents.

The reaction temperature of the copolymerization reaction is generally not more than the boiling point of the solvent although it depends on the solvent and pressure to be used. In general, the reaction temperature of the copolymerization reaction is preferably 40° to 80° C., and particularly preferably 55° to 80° C. When the reaction temperature is too low, it takes much time for polymerization. An attempt to shorten the polymerization time necessitates a large amount of catalyst. On the other hand, when the reaction temperature is too high, it is difficult to control the polymerization, which in turn is not preferable.

The polymerization time is preferably 4 to 10 hours (more preferably 6 to 9 hours) in the batchwise scheme. When the polymerization time is too short, it is necessary to increase the polymerization temperature or to set a greater amount of catalyst. On the other hand, when the polymerization time is too long, there arises a problem in terms of productivity, which in turn is not preferable. In the continuous scheme, the mean residence time in a polymerization tank is preferably 2 to 8 hours (more preferably 2 to 6 hours). When the residence time is too short, it is necessary to increase the polymerization temperature or to set a greater amount of catalyst. On the other hand, when the residence time is too long, there arises a problem in terms of productivity, which in turn is not preferable.

The rate of polymerization (vinyl ester-based monomer) is set to as high a level as possible within a polymerization controllable range in terms of productivity, and is preferably 20 to 90%. When the rate of polymerization is too low, there arise problems in terms of productivity and in the presence of large quantities of unpolymerized vinyl acetate monomers. On the other hand, when the rate of polymerization is too high, it is difficult to control the polymerization, which in turn is not preferable.

Thus, the ethylene-vinyl ester-based copolymer is obtained by the manufacturing method of the present invention. Known methods may be employed for the saponification of the ethylene-vinyl ester-based copolymer.

For the saponification, an alkali catalyst or an acid catalyst is used, with the aforementioned obtained copolymer dissolved in an alcohol or a hydrous alcohol. Examples of the alcohol include methanol, ethanol, propanol and tert-butanol, but methanol is most preferably used. The concentration of the copolymer in the alcohol is selected as appropriate in accordance with the viscosity of the system, and is generally selected from the range of 10 to 60 wt %. Examples of the catalyst used for the saponification include: hydroxides of alkali metal such as sodium hydroxide, potassium hydroxide, sodium methylate, sodium ethylate, potassium methylate and lithium methylate; alkali catalysts such as alcoholate; and acid catalysts such as sulfuric acid, hydrochloric acid, nitric acid, meta-sulfonic acid, zeolite and cation exchange resin.

The amount of usage of such a saponification catalyst is selected as appropriate in accordance with a saponification method, an intended saponification degree and the like. When such an alkali catalyst is used, it is appropriate that the amount of usage is generally 0.001 to 0.1 equivalent, and preferably 0.005 to 0.05 equivalent, based on the total quantities of monomers such as vinyl ester-based monomer. Any one of batch saponification, continuous saponification on a belt and tower-type continuous saponification may be used for such a saponification method in accordance with an intended saponification degree and the like. Preferably, tower-type saponification under a fixed pressure is used for the reason that the amount of alkali catalyst during saponification is reduced and a saponification reaction easily proceeds with high efficiency.

Pressure during saponification is selected from the range of 0.1 to 0.8 MPa although it depends on an intended ethylene content. A saponification temperature is 80° to 150° C., and preferably 100° to 130° C. Saponification time is selected from the range of 0.5 to 3 hours.

Thus, an alcohol solution of EVOH is obtained. Such a solution may be as it is. Preferably, water is directly added to the solution or the concentration of the alcohol solution of the saponified product is adjusted as appropriate after the addition of water, so that a solution for the production of strands is produced as an alcohol/water solution. Thereafter, the solution is extruded and precipitated in the form of strands into the coagulating bath of water, a water/alcohol (mixed) solution or the like.

The precipitated strands are then cut into pellets. The pellets are rinsed with water and dried, so that the pellets of EVOH are produced.

Known drying methods may be employed as the aforementioned method of drying the EVOH resin pellets. Specific examples of the drying method include a ventilation drying method and a fluidized drying method. Also, different drying methods may be employed for multi-stage drying. In particular, a drying method in which the fluidized drying method is used in the first stage and the ventilation drying method is used in the second stage is preferred because it provides good color tones of the pellets and molded parts produced using the pellets. A drying temperature is not particularly limited, but a temperature on the order of 60° to 150° C. is generally employed as the drying temperature. The temperature may be increased as the drying process proceeds. Also, circulating an inert gas such as nitrogen gas during the drying process is preferred because it provides good color tones of the molded parts.

By supplying and circulating an inert gas, e.g. nitrogen gas ($N_2$ gas), as needed to and in a drying container, the amount of volatile matter of the EVOH resin pellets obtained in the pelletizing step is reduced to less than 0.3 part by weight per 100 parts by weight of EVOH resin composition at an end product level. The volatile matter is obtained by calculating a change in weight after the drying of the pellets at 150° C. for 5 hours (including alcohol).

The absolute specific gravity of the aforementioned EVOH resin pellets is not particularly limited, but is generally 1.0 to 1.4. The bulk specific gravity of the aforementioned EVOH resin pellets is not particularly limited, but is generally 0.5 to 0.9.

As mentioned earlier, after being subjected to hot air drying which is the final stage of the aforementioned manufacturing steps, the EVOH resin pellets subjected to the aforementioned pellet drying step are charged into the pellet transport container (a closed tank of a trailer for granules, a bulk vehicle and the like) including the aforementioned pressurizing means while remaining at a high temperature (approximately 60° to 150° C.), and transported, with the openings of the tank sealed, for the purpose of avoiding the moisture absorption of the pellets during the transport and storage of the pellets.

In the method of transporting the saponified ethylene-vinyl ester-based copolymer pellets according to the present preferred embodiment, there also arises a conventional phenomenon such that a negative pressure is developed in the large-sized pellet transport container as mentioned above as the temperature of the pellets and the increased temperature of the air in the container decrease during the transport of the pellets after the hot pellets (approximately 60° to 150° C.) are directly charged into the container to fill the container and the container is closed as it is. However, the method of transporting the pellets according to the present preferred embodiment includes the "pressurizing means" which supplies the dry gas (nitrogen gas) to the aforementioned pellet transport container as mentioned above to always maintain the internal pressure of the pellet transport container at a pressure of more than 1 atm and not more than 1.68 atm (101.3 to 170.2 kPa). This prevents outside air containing much moisture from entering the container to maintain the aforementioned EVOH resin pellets in a dry low-humidity state obtained in the early stage of the charging. This configuration also improves the transport efficiency of the pellets while maintaining the quality of the EVOH resin pellets.

Further, the transported EVOH resin pellets do not have a poor appearance resulting from the foaming of moisture and the like during a subsequent molding process of films and the like, so that the yield of the processed products is improved. This improves the quality of the EVOH as the end product and the molded parts produced using the EVOH, and reduces the total costs of the molded parts produced using the EVOH resin pellets in combination with the improvement in the aforementioned pellet transport efficiency (reduction in raw material costs).

In the aforementioned preferred embodiment, the trailer having the tank for powder and granular materials, the bulk loading vehicle, the tank truck and the like are illustrated as examples of the closed type large-sized tank (pellet transport container) for transporting the EVOH resin pellets. However, other forms including a container form mountable on trains, ships, aircraft and the like and not limited to the aforementioned form may be used for the hermetic container (sealed container) used for the mass transport.

The method of transporting the pellets to the pellet transport container may include the transport using a conveyor and the like in addition to the aforementioned air transport. Further, the temperature of the pellets charged into the pellet transport container is generally approximately 60° to 150° C. (pellet temperature), preferably approximately 70° to 140° C., and more preferably approximately 80° to 130° C. The charging of the pellets at too high of a pellet temperature into the container tends to cause a high negative pressure to be developed after the temperature in the container is decreased to room temperature, and hence is not preferable.

It is desirable that the time required for the transport of the EVOH resin pellets is held down generally to 1 to 7 days, and preferably to 1 to 3 days, although it depends on the distance between plants and the transport means.

EXAMPLES

Next, an example of the present invention will be described in further detail. Modifications (changes) to the example are not limited to the example to be described below unless they exceed the subject matter of the present invention. In the example, the term "part(s)" means "part(s) by weight" unless otherwise specified.

Production of EVOH Resin Pellets

A water/methanol (mixed at water/methanol=40/60 by weight) mixed solution (60° C., an EVOH concentration of 45 wt %) of an ethylene-vinyl alcohol-based copolymer (EVOH) (an ethylene content of 34 mol %, a saponification degree of 99.5 mol %, and a MFR of 20 g/10 min (210° C., a load of 2,160 g)) was extruded in the form of strands into a water bath maintained at 5° C. so as to be coagulated. Thereafter, the strands were cut with a cutter (pelletizer) to provide EVOH in the form of porous pellets (a diameter of 4 mm and a length of 4 mm).

Next, the obtained EVOH in the form of porous pellets was rinsed with water. Thereafter, the EVOH in the form of porous pellets was charged into a water solution containing 0.3 wt % of boric acid and 0.1 wt % of sodium acetate, and agitated at 35° C. for approximately 4 hours. Further, the EVOH in the form of porous pellets was dried at 75° C. for 3 hours in a batchwise tower-type fluidized-bed dryer, and thereafter dried at 125° C. for 18 hours in a batchwise airflow tray dryer. This provided EVOH resin pellets containing 0.03 part of boric acid in boron equivalent and 120 ppm of sodium acetate in sodium equivalent.

The moisture percentage (percentage of moisture content) of the EVOH resin pellets obtained immediately after the drying was 0.09 wt %. The pellets which remained at a high temperature (120° C.) after the aforementioned drying process were immediately charged into a pellet transport container (a closed tank of a trailer for granules) including a pressurizing means for the purpose of avoiding the moisture absorption of the pellets during the transport and storage of the pellets.

Transport of EVOH Resin Pellets

Immediately after the aforementioned drying process, 21,000-kg EVOH resin pellets (at a temperature of 120° C.) were charged into a trailer (with a volume of 46 $m^3$, a material of stainless steel, a pellet insertion port of ¾ inch in size, a pellet take-out port of ¾ inch in size, and closing mechanisms for the pellet insertion port and the pellet take-out port being block valves) including the pressurizing means having a nitrogen cylinder by using an air transport apparatus utilizing wind power. The pellet filling percentage in the tank of the trailer in this example was approximately 50%.

After the openings of the trailer were closed, the aforementioned pressurizing means was put into operation to supply nitrogen gas until a predetermined pressure was reached. With the state of the predetermined pressure maintained, the trailer transported the pellets. During the transport, the cylinder is periodically replaced with another so that the supply of the nitrogen gas from the pressurizing means is prevented from being interrupted or stopped.

Changes in "pressure in the tank" during the actual transport of the pellets and transitions of sampled "moisture percentage (percentage of moisture content) of pellets" are shown in Table 1 below.

TABLE 1

| | Transport Time | | | | |
|---|---|---|---|---|---|
| | Early Stage | After 8 Hours | After 16 Hours | After 24 Hours | After 32 Hours |
| Pressure in Tank (atm) | 1.68 | 1.61 | 1.54 | 1.48 | 1.37 |
| Percentage of Moisture Content of Pellets (wt %) | 0.09 | 0.09 | 0.09 | 0.09 | 0.09 |

Table 1 shows that the interior of the pellet transport container (closed tank of the trailer for granules) is always maintained in a state of higher pressure than the ambient atmosphere during the transport by the operation of the pressurizing means. This shows that the EVOH resin pellets in the transport container do not absorb moisture, so that the percentage of moisture content in the early stage (during the tank charging) is held. Thus, the method of transporting the saponified ethylene-vinyl ester-based copolymer pellets in this example is capable of transporting the pellets in large quantities at one time while maintaining the quality of the EVOH resin pellets as obtained immediately after the production thereof.

Although specific forms in the present invention have been described in the aforementioned example, the aforementioned example should be considered as merely illustrative and not restrictive. It is contemplated that various modifications evident to those skilled in the art could be made without departing from the scope of the present invention.

The method of transporting saponified ethylene-vinyl ester-based copolymer pellets according to the present invention is capable of transporting the pellets in a dry state in large quantities at one time while preventing the pellets being transported from absorbing moisture. Therefore, the transport method according to the present invention improves the transport efficiency of the pellets while maintaining the quality of the pellets.

What is claimed is:

1. A method of transporting saponified ethylene-vinyl ester-based copolymer pellets comprising the steps of:

inserting the saponified ethylene-vinyl ester-based copolymer pellets into a hermetic container to close the hermetic container, the hermetic container including a pressurizer to apply pressure to the interior of the container;

transporting the hermetic container to a destination; and maintaining the interior of the hermetic container in a state of higher pressure than ambient atmosphere by using the pressurizer to apply pressure to the hermetic container during the transporting step, wherein the saponified ethylene-vinyl ester-based copolymer pellets have an amount of volatile matter that is less than 0.3 part by weight per 100 parts by weight of the saponified ethylene-vinyl ester-based copolymer pellets.

2. The method according to claim 1, comprising maintaining the interior of the hermetic container in a state of higher pressure using a dry gas with a moisture percentage of not more than 0.8 wt %.

3. The method according to claim 2, wherein the dry gas is nitrogen gas.

4. The method according to claim 1, wherein the hermetic container is a closed type large-sized tank to transport the pellets.

5. The method according to claim 1, wherein the hermetic container is maintained at an internal pressure of more than 1 atm and not more than 1.68 atm.

* * * * *